United States Patent [19]

Evans et al.

[11] Patent Number: 4,780,363

[45] Date of Patent: Oct. 25, 1988

[54] CARBON FIBRE MATERIALS

[75] Inventors: Maurice J. Evans, Sutton Coldfield; Keith A. Williams, Birmingham, both of England

[73] Assignee: Dunlop Limited, London, England

[21] Appl. No.: 138,292

[22] Filed: Dec. 28, 1987

[30] Foreign Application Priority Data

Jan. 15, 1987 [GB] United Kingdom ..... 8700805

[51] Int. Cl.[4] ..... B32B 5/12

[52] U.S. Cl. ..... 428/300; 28/112; 428/105; 428/408

[58] Field of Search ..... 28/112; 428/234, 300, 428/408, 105

[56] References Cited

U.S. PATENT DOCUMENTS

| | | | |
|---|---|---|---|
| 3,205,342 | 9/1965 | Smith et al. | 28/112 |
| 3,245,854 | 4/1966 | Etchison et al. | 28/112 |
| 3,819,465 | 6/1974 | Parsons et al. | 28/112 |
| 4,726,978 | 2/1988 | Simpson | 428/408 |

FOREIGN PATENT DOCUMENTS

| | | |
|---|---|---|
| 0148539 | 7/1985 | European Pat. Off. . |
| 1366636 | 9/1974 | United Kingdom . |
| 1447030 | 8/1976 | United Kingdom . |
| 012671A | 8/1979 | United Kingdom . |

*Primary Examiner*—James J. Bell

*Attorney, Agent, or Firm*—Lorusso & Loud

[57] ABSTRACT

A sheet of parallel carbon or carbon-precursor filaments is supported by a carrier sheet of fugitive backing material and needle punched. The fugitive backing material is subsequently destroyed leaving displaced or broken portions of the filaments entangled together to provide a stable sheet for composite manufacture, particularly for reinforcement of a carbon-carbon composite.

19 Claims, 1 Drawing Sheet

CARBON FIBRE MATERIALS

Figure 1:
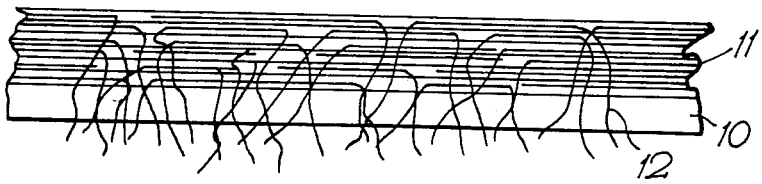

This invention relates to carbon fibre materials, and particularly to the fabrication of sheets of carbon fibre materials for the reinforcement of composite materials.

A carbon fibre reinforcement may be in the form of continuous filament tows. In order to incorporate such material into a composite, for example, a carbon-carbon composite brake disc in which the carbon reinforcement filaments are surrounded by a matrix of deposited carbon, it is necessary to prepare the reinforcement material as a fabric having sufficient stability to enable it to be cut into shaped pieces as required for assembly to produce a disc. The reinforcement material may be of carbon fibre which may be produced from a carbon precursor such as oxidised polyacrylonitrile (PAN) or stabilised pitch fibres; in all these cases the fibres do not adhere together well to enable a stable non-woven fabric to be formed from uni-directionally-aligned continuous filaments. One object of the present invention is to overcome this problem and provide a stable sheet of substantially continuous filaments of carbon fibres or carbon-precursor fibres.

According to the invention there is provided a sheet of needled carbon or carbon-precursor continuous filaments for use in the reinforcement of a carbon-carbon composite, said filaments being bound together in side by side relationship by means of a fugitive material.

Also, in accordance with the invention there is provided a sheet of needled carbon or carbon-precursor continuous filaments for use in the reinforcement of a carbon-carbon composite, said filaments being bound together in side by side relationship to a sheet of fugitive backing material.

Further, in accordance with the invention there is provided a sheet of needled carbon or carbon-precursor continuous filaments for use in the reinforcement of a carbon-carbon composite, said filaments being bound together in side by side relationship and bound to a sheet of fugitive backing fabric by means of interengaged looped or broken portions of adjacent filaments.

In order to produce a sheet comprising continuous carbon filaments, a method in accordance with the invention comprises preparing a sheet of said continuous filaments, applying a fugitive backing material to the continuous filaments, needle-punching said continuous filaments and backing material to bind the filaments to the backing material, and destroying the fugitive backing material so as to leave the filaments bound together by means of interengaged looped or broken portions of adjacent filaments.

By a "carrier sheet" is meant a sheet, for example of fabric, or a film or layer of material deposited from solution or otherwise.

The carrier sheet of fugitive backing material may be removed by decomposition, for example by a high-temperature treatment, vapourisation or dissolution. In the case of carbon-precursor fabrics this is conveniently done during the carbonising process which converts the carbon-precursor to carbon fibre.

It has been found that the needle-punching operation, in which looped or broken portions of the filaments pierce a backing material, produces an intimate entanglement of the filaments which remains during and after the removal of the fugitive backing material. Shrinkage of the filaments during the carbonisation stage helps to stabilise the structure and produce a handleable fabric which can be used for the preparation of composite structures.

The fabric produced by a method in accordance with the invention may be chemically treated at any stage to deposit suitable material to act as an oxidation inhibitor in an eventual carbon-carbon composite. Alternatively, prior to carbonisation the fugitive backing may be infiltrated by a carbonisable substance, which leaves a char residue on subsequent carbonisation and which remains as a carbon matrix to help bond the structure and act as the first step towards the production of a carbon-carbon composite. The carbonisable substance may contain elements, particles or ingredients to act as oxidation inhibitors in an eventual carbon-carbon composite.

The invention still further provides a carbon-carbon composite comprising at least one sheet of needled carbon continuous filaments bound together in side by side relationship by means of interengaged looped or broken portions of adjacent filaments.

Figure 2:
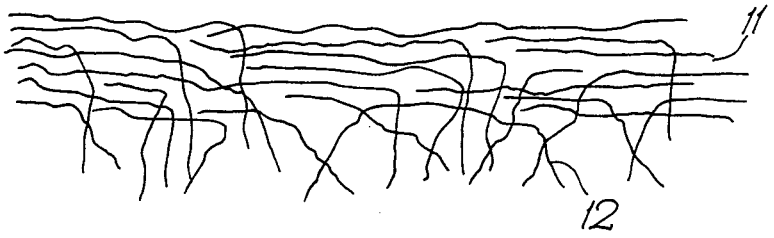

Embodiments of the invention will now be described with reference to the accompanying drawings, in which:

FIG. 1 is a diagrammatic cross-sectional side elevation of part of a sheet of filamentary carbon or carbon-precursor material needled to a fugitive carrier sheet, and FIG. 2 is a view similar to FIG. 1 showing the sheet of filamentary material after destruction of the fugitive carrier sheet.

As indicated diagrammatically in FIG. 1, a carrier in the form of a sheet 10 of a "fugitive" material (i.e. material which can be destroyed, for example vapourised by heating or dissolved in a suitable solvent) is employed to support a sheet 11 of continuous filaments and the two sheets are united by a conventional needle-punching process using barbed needles which break or displace some of the filaments, carrying portions 12 of filaments into or through the carrier sheet as shown.

The combined needled sheets 10 and 11 are then subjected to a process to remove the fugitive substance. If the filaments are carbon-precursor filaments a carbonisation process is also required to convert the filaments to carbon filaments. Where appropriate this process could incorporate removal of the fugitive material. This leaves the filaments of sheet 11 in a carbonised state and portions 12 of these filaments intimately entangled together. The majority of the filaments are however substantially aligned with the original direction in which they are laid on the carrier sheet. A stable, handleable sheet of aligned carbon fibre fabric is thus produced, enabling pieces of the fabric to be prepared by cutting to required shapes and dimensions for incorporation in a carbon-carbon or other composite structure. Sheets may be needled together before removal of the fugitive backing to form a multi-layer sheet, or a thicker multiple-layer stack to provide a preform for composite manufacture. The alignment of filaments in one ply within a multi-layer sheet may cross that of the filaments in another ply.

To complete the manufacture of a composite structure, single-layer or multiple-layer sheets may be stacked and compressed in a suitable jig to give a fibre volume of, for example, approximately 20% and subjected to a chemical vapour deposition process to infiltrate and deposit a matrix of carbon on the fibre structure.

Alternatively, free-standing needled preforms may be similarly processed. One application of the resulting composite structure is in the manufacture of carbon-carbon composite brake discs for an aircraft disc brake, but it is suitable for any other application requiring such material.

A carbon matrix may alternatively be applied, for example, by impregnation with resin or pitch followed by charring.

The aligned carbon fibre fabric may also be used in the manufacture of carbon fibre reinforced plastics, especially where these are of complex shape and good fabric "drapeability" is required.

More detailed examples of the preparation of a sheet of carbon fibre filaments are given below:

EXAMPLE 1

A 320K filament oxidised PAN tow was spread to a width of 130 millimeters and needled to a spunbonded polyester fabric producing a fabric having a weight of 500 grams per square meter. The fabric was carbonised at a temperature of 1100° C. giving a final weight of 350 grams per square meter.

EXAMPLE 2

A 320K filament oxidised PAN tow was spread to a width of 260 millimeters and needled to a spunbonded polyester fabric producing a fabric having a weight of 285 grams per square meter. The fabric was carbonised at a temperature of 1100° C. giving a final weight of 170 grams per square meter.

EXAMPLE 3

A total of 5×320K filament oxidised PAN tows each of 130 millimeters in width were run side by side and needled to a spunbonded polyester fabric to give a width of 640 millimeters and a weight of 510 grams per square meter. After carbonising at 1100° C. the fabric had a final weight of 385 grams per square meter.

EXAMPLE 4

A sheet of fabric produced by the method described in Example 3 was cross laid on to a similar fabric, such that the continuous filaments of each sheet crossed each other at 90° and these were needled together producing a fabric of width 640 mm and a weight of 1100 grams per square meter. After carbonising at 1100° C. the fabric had a final weight of 700 grams per square meter.

EXAMPLE 5

A 320K filament carbon tow was spread to a width of 180 millimeters and needled to a fugitive backing of spunbound polyester fabric producing a fabric having a weight of 295 grams per square meter before destruction of the polyester fabric.

The technique in accordance with the invention as described with reference to the examples given above enables a fully or partly carbonised sheet of aligned continuous filaments to be prepared. This has substantial advantages, especially in terms of cost, over existing processes in which cross-laid staple fibre material is employed to provide a stable, handleable fabric.

We claim:

1. A sheet of needled carbon or carbon-precursor continuous filaments for use in the reinforcement of a carbon-carbon composite, said filaments being bound together in side by side relationship by means of a fugitive material.

2. A sheet of needled carbon or carbon-precursor continuous filaments for use in the reinforcement of a carbon-carbon composite, said filaments being bound together in side by side relationship to a sheet of fugitive backing material.

3. A sheet of needled carbon or carbon-precursor continuous filaments for use in the reinforcement of a carbon-carbon composite, said filaments being bound together in side by side relationship and bound to a sheet of fugitive backing fabric by means of interengaged looped or broken portions of adjacent filaments.

4. A sheet of carbon-precursor filaments according to claim 1 wherein the filaments are treated with a carbonisable substance to produce on heating a char to help bind the filaments.

5. A sheet in accordance with claim 1 having an oxidation inhibitor deposited thereon.

6. A sheet of carbon-precursor filaments according to claim 4 wherein the carbonisable substance contains an oxidation inhibitor.

7. A stack of sheets in accordance with claim 1 needled together as a preform for manufacture of a carbon-carbon composite.

8. A stack of sheets in accordance with claim 7 wherein the alignment of filaments in one sheet crosses that of the filaments in another sheet.

9. A multi-layer sheet formed from sheets in accordance with claim 1 by the needling together of such sheets and removal of the fugitive material.

10. A multi-layer sheet formed from sheets of carbon-precursor filaments in accordance with claim 1 by the needling together of such sheets before carbonisation.

11. A multi-layer sheet in accordance with claim 9 in which the alignment of the filaments in one ply of the multi-layer sheet crosses that of the filaments in another ply of the multi-layer sheet.

12. A carbon-carbon composite comprising at least one sheet of needled carbon continuous filaments bound together in side by side relationship by means of interengaged looped or broken portions of adjacent filaments.

13. A carbon-carbon composite comprising at least one sheet of carbon or carbon-precursor filaments in accordance with claim 1.

14. A method for producing a stable sheet of needled carbon or carbon-precursor continuous filaments in side by side relationship comprising preparing a sheet of said continuous filaments, applying a fugitive backing material to the continuous filaments, needle-punching said continuous filaments and backing material to bind the filaments to the backing material, and destroying the fugitive backing material so as to leave the filaments bound together by means of interengaged looped or broken portions of adjacent filaments.

15. A method according to claim 14 wherein the fugitive backing material is destroyed by a high-temperature treatment which also serves to carbonise carbon-precursor continuous filaments of said sheet.

16. A method according to claim 14 comprising the step of needling together sheets to form a multiple-layer sheet before removal of the fugitive backing.

17. A method according to claim 14 comprising the step of needling together sheets to form a multiple layer stack before removal of the fugitive backing to provide a multiple-layer preform for composite manufacture.

18. A method according to claim 16 wherein the alignment of the filaments in one sheet crosses that of the filaments in another sheet.

19. A stable single- or multi-layer sheet of needled carbon or carbon-precursor continuous filaments prepared by a method in accordance with claim 14.

* * * * *